United States Patent [19]

Bailet

[11] Patent Number: 4,956,880

[45] Date of Patent: Sep. 18, 1990

[54] ACTUATING DEVICE FOR MOVING A VALVE FOR EMPTYING A FLUSH TANK

[75] Inventor: Jean-Claude Bailet, Villefranche, France

[73] Assignee: Siamp Cedap S.A., Monaco

[21] Appl. No.: 365,134

[22] Filed: Jun. 5, 1989

[30] Foreign Application Priority Data

Oct. 5, 1987 [FR] France ..... 87 13720

[51] Int. Cl.[5] ..... E03D 1/34

[52] U.S. Cl. ..... 4/413; 4/378

[58] Field of Search ..... 4/378, 405, 410, 411, 4/413, 414

[56] References Cited

U.S. PATENT DOCUMENTS

| | | | |
|---|---|---|---|
| 2,543,438 | 2/1951 | Cochran | 4/411 |
| 4,566,140 | 1/1986 | Musgrove | 4/413 X |

FOREIGN PATENT DOCUMENTS

| | | | |
|---|---|---|---|
| 572295 | 11/1958 | Belgium | 4/414 |
| 2591250 | 6/1987 | France | 4/378 |
| 267429 | 3/1927 | United Kingdom | 4/405 |

*Primary Examiner*—Charles E. Phillips

*Attorney, Agent, or Firm*—Horst M. Kasper; 10

[57] ABSTRACT

The invention relates to a device for the actuation of the valve of a flush tank: a movable vertical tube (8) carries a valve (7). A linking rod (9) controls the movement of the tube, a lever (12) operates the linking rod, a member (16) operates a rod (15), which in turn controls the lever (12). The rod (15) is connected to the lever (12) and to the operating member (16), the operating member having two positions, one being the opening position (26), and the other one being the closing position (27), and the passage of the member from one to the other one of these positions, controlled by the user, bring about the correlative passage of the valve (7) from one (26") to the other one (27") of the positions and inversely.

17 Claims, 1 Drawing Sheet

ACTUATING DEVICE FOR MOVING A VALVE FOR EMPTYING A FLUSH TANK

CROSS REFERENCE TO RELATED APPLICATIONS

This application is a continuation-in-part application of another international application filed under the Patent Cooperation Treaty on Oct. 3, 1988, bearing Application No. PCT/FR88 /00488, and listing the United States as a designated country. The entire disclosure of this latter application, including the drawings thereof, is hereby incorporated in this application as if fully set forth herein.

BACKGROUND OF THE INVENTION

1. Field of the Invention

The present invention relates to a device for the actuating of a valve for emptying a flush tank, in particular for a water-tank reservoir for flushing of a toilet bowl.

2. Brief Description of the Background of the Invention Including Prior Art

Water-flush tanks are all equipped with an emptying or discharge device. These tanks are generally located either at a certain height, where the emptying device is actuated by a lever, extended by a chain or by another known means, or they are located right above the toilet bowl, where the tanks are covered with a cover lid, outfitted with a pushbutton which has to be pushed or pulled in order to initiate the emptying.

The emptying or discharge devices disposed at a higher level, although functioning well in general, are cumbersome and do not allow the interruption of the water flow since one cannot manually close the valve with the pull chain. This represents an inconvenience, since frequently only a part of the water contained in the flush tank would be sufficient to rinse the toilet bowl, which would allow to economize considerable amounts of water.

The devices operated by a pull cord or pull chain, even if they allow an interruption of the water flow by again pulling the chain downwardly, nevertheless represent the inconvenience of being fragile, they twist, they are pulled out, or they are broken.

In order to provide a solution to this inconvenience, there have been created emptying devices operated by push button This technique is characterized by the inversion of the motion. The valve is lifted and opened by pushing a button downwardly by a short-stroke distance (the relative motions of the valve and of the pushbutton are inversed), which button then returns by the action of a spring, while allowing the water to empty. According to this technique, there exist also simple-action pushbuttons, where the mechanic construction only allows the opening of the valve. These buttons have the advantage of being less costly and being sturdy, but they do not allow the interruption of the water flow.

There exist further dual-action pushbuttons which allow, in a first step, to open the valve (upward movement) by pushing the button (downward movement) and, in a second step, to close the valve (downward movement) before the complete emptying of the tank by pushing the button (downward movement) a second time. Such a device is, for example, taught in the French Patent No. FR 2,548,328. A pushbutton is vertically displaced and comes to rest on a lever connected to a linking rod, which controls the opening or the closing of the emptying or discharge valve. According to the position of the lever, i.e. depending on whether the valve is open or closed, the button, by moving downwardly, lowers or lifts the lever and can thus interrupt the flow of the water. In order that the same vertical displacement of the pushbutton can provide two opposite results (opening - closing), the device comprises an extending member, which pivots laterally between two positions, one for each function.

These devices nevertheless present the inconvenience of being complex due to the inversion mechanics of the movement. They are cumbersome and they are difficult to adapt to the different height levels of the tank.

On the other hand, there exists some kind of standard relating to cover lids of ceramic toilet tanks. This standard is characterized by dimensions and by a central opening, at the position of the axis of the emptying or discharge valve, which is provided for the placing of the operating member of the emptying or discharge device.

The construction specialists of emptying or discharge devices consequently look to provide devices which are to be furnished for mounting on these cover lids having an axial opening. The apparatus precedingly taught, with pushbuttons, are part of this group.

There are also other devices allowing to simply interrupt the emptying, in particular the device with a hinge or pivot described in the German Patent No. DE 3,605,188.

This device teaches a member disposed on the side of the tank, which pivots around an axis between two positions. The member is connected to the axis of the valve by an arm, which acts as lever, in such a way that one position of the member actuates the lever, which opens the valve, and the other position of the member inversely actuates the lever, which closes the valve. Nevertheless, this device cannot be disposed on the cover lids having an axial opening.

SUMMARY OF THE INVENTION

1. Purposes of the Invention

It is an object of the present invention to obviate the inconveniences associated with conventional constructions.

It is another object to provide a discharge-valve actuating device for a flush tank of the kind having an operating member, pivoting between two positions, of which one is the open position and the other one is the closed position of the valve, capable of saving water if desired.

It is yet a further object of the invention to provide a flush tank of the type with a cover lid having a central opening for the operating member with a simple but effective and complete control of the flush tank operation.

These and other objects and advantages of the present invention will become evident from the description which follows.

2. Brief Description of the Invention

The invention device comprises a body rigidly mounted to the bottom of a flush tank. A valve rests on a vertical tube. This tube can be displaced in axial direction in the body of the invention device. A connecting rod is disposed shifted or offset relative to the axis of said tube. The connecting rod is intended to control and actuate the movements of said tube. An operating lever actuating the connecting rod is hinged around a horizontal first pivot axis.

A control rod in turn actuates the operating lever. The control rod is located substantially in the tube axis and is mechanically connected, on the one hand, to the operating lever and, on the other hand, to an operating member. The control rod is further guided in a case, which is mounted integral with the tank reservoir. The guide for the control rod renders the control rod immobile in a cross direction, that is in a horizontal direction.

The mechanical connection between the control rod and the operating lever is furnished by a cog, carried by the control rod and sliding in an elongated opening disposed in the operating lever and running parallel to the longitudinal direction of the operating lever. The mechanical connection between the control rod and the operating member is furnished by a rocker bar forming an integral part with the operating member and cooperating with and engaging an inclined ramp carried by the control rod.

The device is further defined by the following advantageous features. The operating member is hingedly pivoting around a horizontal axis. The rocker bar is shifted or offset relative to the hinge axis of the operating member and to the axis of the control rod. The elongated opening is disposed between the hinge axis of the operating lever and its opposite hinge extremity at the linking rod. The control rod comprises a nut movable along the rod by threading. The control rod further carries the connecting cog for adapting the position of said cog along the rod to the dimensions of the tank, i.e. the distance of the connection "control rod-operating lever" to the connection "control rod - operating member."

The operating lever comprises two identical parallel arms, one arm on each side of two opposite sides of the control rod. Upon completion of the emptying of the flush tank, the automatic closing of the valve induces, by the mechanical connection "tube - linking rod - operating lever - control rod - rocker bar", the return to the closing position of the operating member.

The operating member comprises a flat circular base near the pivoting axis and includes an upper hemispherical face recessed symmetrically relative to the axis in order that the operating member at each of the two positions presents a protruding face on which a cog can push in order to provoke the pivoting motion, with the other face being merged and in continuity with the immediately neighboring face.

The upper end of the body of the device includes a sleeve of a general cylindrical form, which is fixed in its height, and which is provided with a threaded opening for receiving the case. The case includes on the outside a threading intended to cooperate with the threading of the sleeve, and comprises on the top an abutment shoulder on the outer face of the cover lid, such that the case is mounted and fixed in position in the sleeve by screwing.

The threading of the case and of the rod are coaxial and of the same pitch in order to simultaneously mount the control rod in the nut and the case in the sleeve. This is associated with the advantage of substantially simplifying the assembly. At the time of the assembly, the pieces are simultaneously assembled and there is no need for any additional adjustments.

It is well understood that the invention is not limited to this specific form of operating member and that all other members, which can move around a horizontal axis, are an equivalent within the scope of the invention.

Similarly, it is not indispensable that the actuating rod is vertical, with or without case. It is possible to put it at an inclined position, even up to a horizontal position, and to transmit the motion, produced by the pivoting, in an equivalent fashion onto the lever.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible features of the present invention.

DESCRIPTION OF INVENTION AND PREFERRED EMBODIMENT

Figure 1:
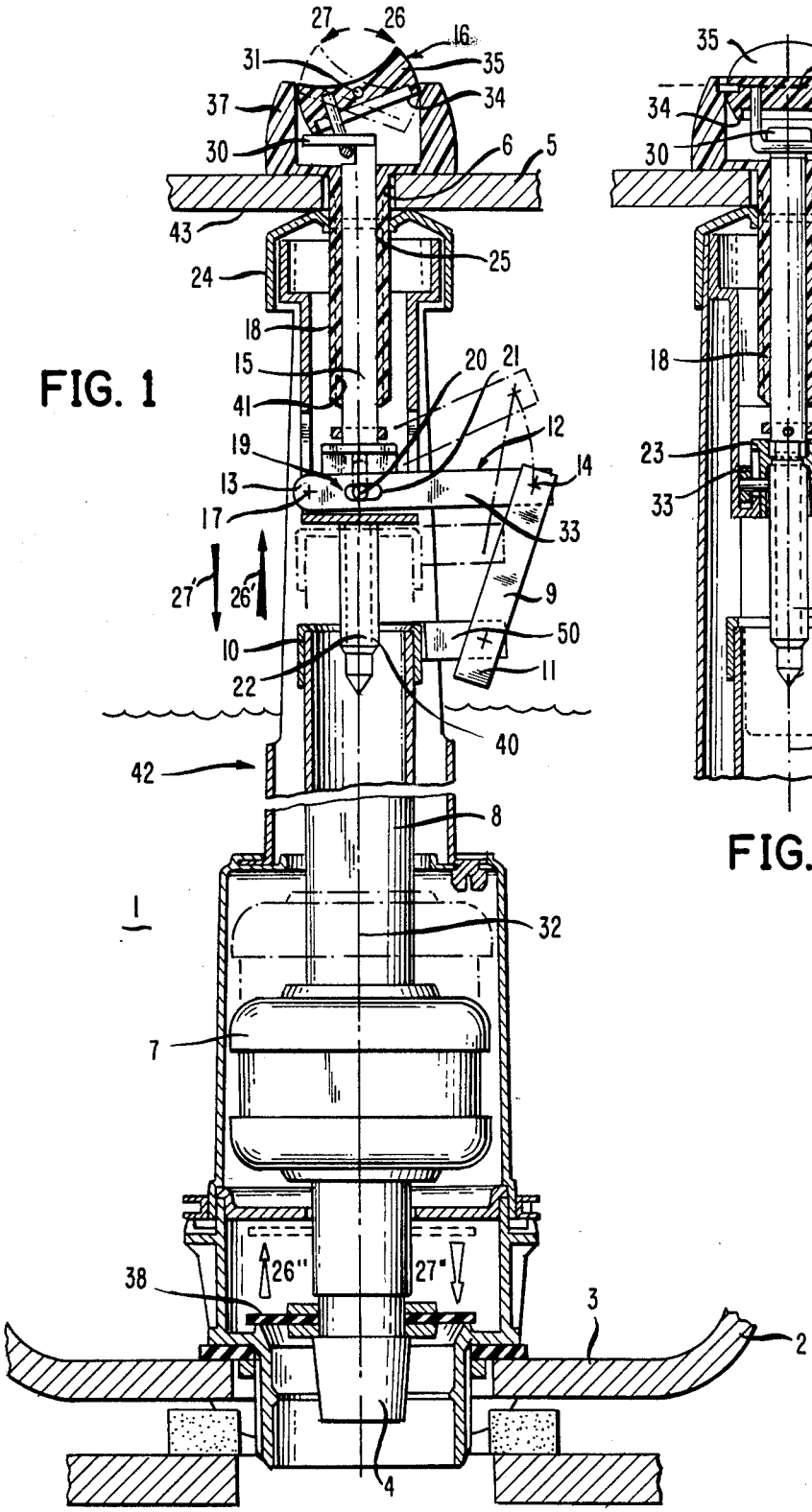
FIG. 1 is a vertical sectional view of a device according to the invention mounted on a flush tank of a toilet.
Figure 2:
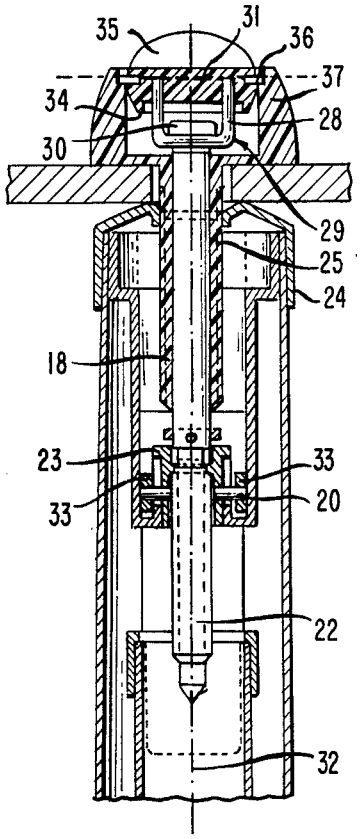
FIG. 2 is a vertical, partially sectional view of the profile of the device of FIG. 1.

In accordance with the present invention, there is provided a discharge-valve actuating device for a flush tank reservoir. The reservoir tank is furnished with an open top and a bottom. A cover lid 5 has a central opening 6 for positioning and supporting the operating member 16 and mates the top of the reservoir tank. A valve 7 is supported by a vertically disposed tube 8. An operating member 16 is hinged for providing a first operating position corresponding to an open position of the valve 7, and for providing a second operating position corresponding to a closed position of the valve 7. A body 42 is mounted solidly to the bottom 3 of the reservoir tank 2 and the vertical tube 8 is shiftable in axial direction in the body 42. A case 18 is solidly attached to the body 42 and to the reservoir tank 2. A linking rod 9 is pivotably attached to the tube 8 and disposed at an angle relative to the axis of the tube and constructed to transfer the vertical motion of said tube. An operating lever 12 is pivotably attached at a first pivot axis to the linking rod 9 and is hinged along a horizontal axis, solidly attached to the body 42, and has an elongated opening 21. A control rod 15 is disposed substantially in the axis of the tube 8 and is mechanically connected, on the one hand, to the operating lever 12 for engaging the operating lever and, on the other hand, to the operating member 16, and is guided in the case 18. A cog 20 is attached to the control rod 15, wherein the cog 20 forms a mechanical connection 19 between the rod 15 and the operating lever 12 and wherein the cog 29 slides in the elongated opening 21 of the operating lever 12. A ramp or laterally extending bar 30 is carried by the control rod 15. A rocker bar 28 is attached to the operating member 16 for supplying a mechanical connection 29 between the control rod 15 and the operating member 16 by engaging the ramp 30 carried by the control rod 15.

The operating member 16 can be hingedly mounted around a horizontal axis 31 and the case 18 can be fixed against lateral motion.

A housing can be attached to the cover lid 5, wherein the operating member 16 comprises a flat, circular base 34. Said base 34 can be closely neighboring the hinge axis. The operating member 16 can comprise an upper hemispherical face , recessed symmetrically relative to an axis in order that the operating member 16 can present a protruding face on which a cog 20 can rest for provoking the pivoting motion at each of two limiting positions. A thereto opposite face of the operating member 16 can be formed for allowing continuity with an immediately neighboring face of the housing.

The rocker bar 28 can be shifted relative to the hinge axis 31 of the operating member 16 and relative to the axis 32 of the control rod 15.

The operating lever 12 can be pivoted to the control rod 15 at a second pivot axis. The elongated opening 21 can be disposed between the second pivot axis 17 of the operating lever 12 and the first pivot axis of operating lever 12 and linking rod 9.

The control rod 15 can be furnished with threads 40 and comprise a nut 23 movable on the rod 15 and engaging the threads 40 of the control rod 15. The nut 23 can carry the cog 20 furnished for adapting the distance of a connection 19 "control rod - operating lever" to a connection 29 "control rod - operating member" to the dimensions of the reservoir tank 1.

The operating lever 12 can comprise two identical parallel arms 33 with one arm on each side of the control rod 15.

A mechanical connection "tube - linking rod lever - control rod - rocker bar" can induce, at the end of the emptying, the return to a closing position 27 of the operating member 16 by an automatic closing of the valve 7.

The body can comprise a sleeve 24 of a cylindrical shape at its upper end 42. Said sleeve 24 can be disposed at a fixed height level and be equipped with a threaded opening 25 for receiving the case 18. The case 18 can comprise on its outside a threading 41 for engaging with the threading of the sleeve. Furthermore, the case 18 can include on its upper side an abutment shoulder 43 disposed on the outer face of the cover lid 5 in such a way that the case 18 can be mounted and fixed in the sleeve 24 by screwing.

The threading 41 of the case 18 and the threading 40 of the control rod 15 can be coaxial and of the same pitch in order to simultaneously mount the control rod 15 in the nut 23 and the 18 case in the sleeve 24.

A method for actuating a discharge valve for a flush tank comprises the following steps. An operating member 16 is manually pivoted around a hinge axis from a closed valve position to an open valve position. A ramp 30 with a rocker bar 28 attached to the operating member 16 is thereby entrained in an upward direction and transfers and transforms via a sliding and lifting motion the ramp motion into a valve opening motion. The operating member 16 is manually pivoted from a closed valve position to an open valve position, thereby using the operating member 16 to push the ramp 30 down and transferring and transforming the downward ramp motion into a valve closing motion. The operating member 16 is manually pivoted from a closed valve position to an open valve position, thereby entraining in the upward direction the ramp 30 with a rocker bar 28 attached to the operating member 16 and transferring and transforming the ramp motion into the valve opening motion. The tank is allowed to fill and closes thereby the valve 7, thereby pivoting and automatically pushing the operating member 16 from a closed valve position to an open valve position using the ramp 30 to pull and rotate the operating member 16 around the hinge axis and transferring the downward ramp motion into an operating member return motion toward the rest position with a closed flush valve.

FIG. 1 illustrates the interior of a flush reservoir 1, which is traversed by the discharge-valve actuating device. This reservoir 1 includes a tank 2 with a base 3, which is pierced by an opening 4 or discharge drain, and a cover lid 5, pierced by an opening 6, provided for receiving the operating member 16 of the actuating device.

The emptying device comprises a valve 7, of a conventional type supported by a tube 8, hollow, vertical, vertically displaceable in the interior of a solid body 42, fixed on the base 3 of the tank 2, and including, at its lower end, a sealing rubber gasket 38. When the tube rests on the base 3, the valve is closed and the tank can be filled with water.

The opening diameter of the rubber gasket 38 can be from about 1.5 to 2 times the total length of the operating member 16. The diameter of the opening to be closed by the sealing rubber gasket 38 can have a diameter of from about 3 to 10 times, and preferably from about 4 to 6 times the diameter of the control rod 15. The diameter of the opening to be closed by the sealing rubber gasket 38 can be from about 1.5 to 3 times, and preferably from about 2 to 2.5 times the total vertical shift between the closed and the fully open position.

If the water level in the tank 2 passes beyond the level of the upper end of the tube 8, the water flows into the hollow of the tube and is drained.

A linking rod 9 is adapted for controlling the vertical displacements of the tube 8. The linking rod 9 is shifted or offset relative to the axis of the tube. The tube 8 includes at its upper end a collar 10, laterally producing an extension 50 on which the lower end 11 of the linking rod 9 is hinged.

An operating lever 12 for the linking rod 9 is hinged at one of its two ends 13 on a horizontal axis 17, and fixed relative to the cover lid 5 of the reservoir 1. The second end of the operating lever is hinged to the linking rod 9 at its opposite end 14.

A control rod 15 for actuating the operating lever 12 traverses on the one hand the opening provided in the cover lid. On the other hand, the control rod 15 is mechanically linked to the lever 12.

An operating member 16 is accessible from the outside. The operating member is mechanically linked to the control rod 15 of the lever 12. This operating member 16 has two stable positions corresponding to the positions as indicated by the arrows in FIG. 1, wherein a first position corresponds to a closing position 27 and wherein a second position corresponds to an open position 26. The passage from one position 27 to the other position 26 of the operating member 16 brings about a respective passage of the tube 8 and of the valve 7 from the first position 27', 27" to the second position 26', 26" of their respective positions and vice versa.

The connection 19 of "control rod - operating lever" is disposed between the two ends or two pivot axes 13, 14 of the operating lever 12, on the side of the pivot axis 17 in order to reduce the motion path length of the end or pivot axis 14 of the lever while the connection control rod - operating lever moves.

The distance of the first pivot axis 14 from the second pivot axis 17 can be from about 2 to 8, and preferably from about 3 to 5 times the distance from the elongated opening 21 to the second pivot axis 17. The distance of motion of the valve 7, between its extreme positions, can be from about 0.5 to 1 times the length of the operating member 16. The length between the lower pivot axis of the linking rod 9 and the first pivot axis 14 of the linking rod 9 can be from about 0.8 to 1.2 times the distance between the pivot axis 14 and the elongated opening 21.

The distance of the lower pivot axis of the linking rod 9, said lower pivot axis located at the overlap of the linking rod 9 and an extension of the collar 10, and the center axis defined by the control rod 15, can be from about 0.5 to 0.9 and preferably from about 0.6 to 0.8 the distance of the first pivot axis 14 to the center of the elongated opening 21.

The longitudinal direction of the linking rod 9 can form an angle of from about 5 to 15 degrees relative to the axis of the control rod 15 in the open position of the valve and can form an angle of from about 15 to 30 degrees relative to the axis of the control rod 15 in the closed position of the valve.

The reduction of the travel path length of the control rod 15 allows the opening and the closing of the valve 7 with a small depression of the operating member. The length of the lever is calculated in such a way that the reduction is adequate for a complete and quick flow-out of the water.

The control rod 15 is guided in a case 18 forming an integral unit with the reservoir 1 and fixed in position. The connection 19 "control rod - operating lever" is realized by at least one cog 20 supported by the control rod 15 and sliding in an elongated opening 21 of the lever 12, according to the illustrated embodiment.

The outer diameter of a casing around the valve can be from about 2 to 3 times the length of the operating member 16. The distance of the second pivot axis 17 to the center of the elongated opening 21 can be from about 0.9 to 1.1 times the distance of the second pivot axis 17 to the center of the rod 15.

The line between contact point of the rocker bar 28 with the ramp 30 and the hinge axis of the operating member 16 can be at a position which is at an angle of from about 10 to 20 degrees relative to a vertical line passing through the hinge axis of the operating member 16 in a first position corresponding to a closed valve. The operating member 16 can rotate into a second position, wherein the line between contact point of the rocker bar 28 with the ramp 30 and the hinge axis of the operating member 16 form an angle of from about 40 to 80 degrees relative to the vertical axis through the hinge axis of the operating member 16, and preferably an angle of from about 50 to 70 degrees relative to said vertical through the hinge axis of the operating member 16. The horizontal extension of the ramp 30, relative to a vertical passing through the hinge axis of the operating member 16, can be from about 1 to 1.5, and preferably from about 1.1 to 1.3 times the distance between the contact point of the rocker bar 28 with the ramp 30 and the hinge axis of the operating member 16 at the closed position of the valve. The operating member additionally can engage the ramp and move it from an open position of the valve to a closed position of the valve when pressed, relying on a lower end edge engaging the ramp from above. Since the angle vertical line contact point rocker and ramp is smaller as compared to the angle vertical line contact point rocker and lower end edge, there results a certain play between operating member - rocker and ramp in all positions except for the closed valve position.

Furthermore, there is illustrated in the embodiment a vertical position of the rod 15 situated and contained substantially in the axis of the tube 8. The control rod 15 extends toward the lower part 22 in the tube in order to serve as shifting guide for the tube.

The operating lever comprises two identical parallel arms, which extend from each side of the control rod. Furthermore, in this example, the arms are in a substantially horizontal position while the flush valve is in the closed position 27.

The rod 15 has threads 40 and carries a nut 23. The latter has the shape of a sleeve or of a tubular ring and comprises in its interior a threading designed to cooperate with the threading of the rod. Thus, the nut is integral with the rod and can be moved along its threaded part by a respective rotation of the nut and of the rod. The nut carries two coaxial cogs 20 which extend on each side of the rod 15 and traverse each the elongated opening of the corresponding arm of the lever. Thus, the nut is immovable in rotation, and at the time of assembly of the device in the reservoir 1, the rod can be put in place relative to a height level with respect to the cover lid 5, by rotation in the threading of the nut 23.

In the example, there is further illustrated that the case includes on the outside a thread 41, and on the top an abutment shoulder 43 intended to abut against the outer face of the cover lid 5. The hinge axis 17 of the lever 12 is mounted on a sleeve 24, which sleeve 24 is of a general cylindrical shape. This sleeve is integral with the upper end of the body 42 of the device, which body is itself rigidly mounted on the base 3 of the tank 2. The upper end of the sleeve 24 is thus fixed in height. It comprises an opening 25 in the form of a threading intended to receive, guide, and maintain in position the threaded case 18. The threads of the opening 25 and of the nut 23 are coaxial and of identical pitch.

Based on this construction, the mounting of the device is performed successively in the following manner. The body 42 is fixedly attached on the base of the tank 2. The control rod 15 is mounted in the case 18. The rod and the case are screwed together respectively in the sleeve 24 and in the nut 23 by way of the opening 6 of the cover lid 5. When the abutment shoulder 43 of the case comes to rest on the cover lid, then the screw motion pulls the sleeve 24 upwardly. Since the sleeve 24 forms an integral part with the bottom 3 of the tank, the connection case - sleeve is therefore a rigid connection. In particular, the two pieces, sleeve 24 and case 18, are rigidly fixed, and mounting of the device is complete. The drawing illustrates the case where the sleeve 24 comes to abut against the inner face of the cover lid, but this disposition is not a requirement.

In the embodiment illustrated, the mechanical connection 29 "control rod - operating member" is achieved by a rocker bar 28 forming an integral unit together with the operating member 16. The operating member 16 cooperates with a lateral extension of the rod 15 formed as an inclined ramp 30. In this arrangement, the operating member 16 is hingedly mounted around a horizontal hinge axis 31, and the rocker bar 28 is mounted, displaced and offset relative to this horizontal hinge axis 31 and relative to the axis 32 of the control rod 15.

The useable end switch positions of the operating member 16 around the hinge axis can include an angle from about 30 to 60 degrees and preferably an angle from about 40 to 50 degrees. The rocker bar 28 can be supported such that its arms oscillate between two vertical positions with the ramp disposed in a substantially horizontal position.

When the operating member 16 tilts from the closed position 27 to the open position 26, the operating member 16 carries along the rocker bar 28 which displaces itself with the ramp 30. The end of the rocker bar passes a circular path and slides on the lower face of the ramp by lifting it with the control rod 15. The displacement 26' of the control rod 15 necessarily brings about the displacement of the nut 23 and of the cogs 20, which lift up the lever 12. This movement is transmitted to the tube 8 and the valve opens.

Inversely, when the level of the water falls, the tube 8 lowers again, carrying along the linking rod 9, the operating lever 12, and the control rod 15 in a closing movement 27'. The ramp 30 pulls the rocker bar 28 downwardly and with it the operating member 16.

According to the invention, the device allows to interrupt the flow of water during the emptying of the tank. When the operating member 16 is in an opening position 26, the operating member 16 moves by pivoting or tilting into an opposite closing position 27. Simultaneously, the ramp 30 is carried downwardly, and with the ramp 30 also the control rod 15 (closing motion 27'), the operating lever 12, the linking rod 9, and the tube 8, and the valve 7 closes (direction 27'').

The operating member 16 can be provided in various structures. It is only preferred tiltable and to comprise a connecting rocker bar shifted in relation to the hinge axis 31. According to an embodiment, the operating member 16 comprises a circular base 34 and a hemispheric upper face symmetrically recessed relative to the hinge axis 31. This hemisphere 35 is pivotally mounted by two pins 36 in a housing 37 integral with the case 18.

According to the example, the case 18 and the housing 37 are formed of a single block, for example, of a molded plastic material.

The recess is cylindrical, of an axis parallel to the hinge axis 31 in such a way that at each of the positions 26 or 27, the operating member presents an edge which merges with the edge of the housing 37 or of any other immediately neighboring surface, while the other edge projects therefrom and represents a support face for the switching.

According to this embodiment, it is the lower, circular base 34 of the operating member 16 which rests on the ramp 30 when the emptying is manually interrupted.

It will be understood that each of the elements described above, or two or more together, may also find a useful application in other types of flush system configurations and flow interruption procedures differing from the types described above.

While the invention has been illustrated and described as embodied in the context of an actuating device for a valve for emptying a flush tank, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A discharge-valve actuating device for a flush tank reservoir comprising a reservoir tank having an open top and having a bottom;

a cover lid having a central opening for positioning and supporting the operating member and mating the top of the reservoir tank;

a vertically disposed tube;

a valve supported by the vertical tube;

an operating member pivotally mounted on said tank exterior for providing a first operating position corresponding to an open position of the valve, and for providing a second operating position corresponding to a closed position of the valve;

a body mounted solidly to the bottom of the reservoir tank and wherein the vertical tube is shiftable in axial direction in the body;

a case solidly attached to the body and to the reservoir tank;

a linking rod pivotably attached to the tube and disposed at an angle relative to the axis of the tube and constructed to transfer the vertical motion of said tube;

an operating lever pivotably attached at one end via a first pivot axis first pivot axis to the linking rod and pivotally attached to the body at the other end and having an elongated opening between said pivot axis; a control rod disposed substantially in the axis of the tube and mechanically connected, on the one hand, to the operating lever for engaging the operating lever and, on the other hand, to the operating member, and guided in the case;

a cog attached to the control rod, wherein the cog forms a mechanical connection between the rod and the operating lever and wherein the cog slides in the elongated opening of the operating lever;

a laterally extending bar carried by the control rod exterior of said tank;

a rocker bar attached to the operating member on one side of said pivotal mount for supplying a mechanical connection between the control rod and the operating member by engaging said bar in a sliding lifting manner to lift said valve.

2. The discharge-valve actuating device for a flush tank reservoir according to claim 1, wherein the operating member is hingedly mounted around a horizontal axis and wherein the case is fixed against lateral motion.

3. The discharge-valve actuating device for a flush tank reservoir according to claim 2 further comprising a housing attached to the cover lid, wherein the operating member comprises a flat, circular base, said base closely neighboring the pivot axis, and wherein the operating member comprises an upper hemispherical face, recessed symmetrically relative to an axis in order that the operating member presents a protruding face on which a cog can rest for provoking the pivoting motion at each of two limiting positions, where a thereto opposite face of the operating member is formed for allowing continuity with an immediately neighboring face of the housing.

4. The discharge-valve actuating device for a flush tank reservoir according to claim 1, wherein the rocker bar is shifted relative to the pivot axis of the operating member and relative to the axis of the control rod.

5. The discharge-valve actuating device for a flush tank reservoir according to claim 1, wherein the control rod is furnished with threads and comprises a nut movable on the rod and engaging the threads of the control rod and wherein the nut carries the cog.

6. The discharge-valve actuating device for a flush tank reservoir according to claim 1, wherein the operating lever comprises two identical parallel arms with one arm on each side of the control rod.

7. The discharge-valve actuating device for a flush tank reservoir according to claim 1, wherein, the return to a closing position of the operating member is automatic.

8. Discharge-valve actuating device for a flush tank reservoir according to claim 1, wherein the body comprises a sleeve of a cylindrical shape at its upper end which sleeve is disposed at a fixed height level and which sleeve is equipped with a threaded opening for receiving the case and wherein the case comprises on its outside a threading for engaging with the threading of the sleeve, and wherein the case includes on its upper side an abutment shoulder disposed on the outer face of the cover lid in such a way that the case is mounted and fixed in the sleeve by screwing.

9. The discharge-valve actuating device for a flush tank reservoir according to claim 8, wherein the threading of the case and the threading of the control rod are coaxial and of the same pitch in order to simultaneously mount the control rod in the nut and the case in the sleeve.

10. The discharge-valve actuating device for a flush tank reservoir according to claim 1, wherein the rocker bar and the laterally extending bar have engagement points corresponding to the position of the operating member and where the limiting positions of the operating member correspond to angles from about 10 to 20 degrees for the closed position and from about 50 to 70 degrees for the open position as determined between a vertical line and a shortest connection line between a respective engagement point and the hinge axis.

11. A discharge-valve actuating device for a flush tank reservoir of the type with an operating pivot to two positions, one for the opening and one for the closing of the valve, with the reservoir being of the type with a cover lid having a central opening for the operating member and comprising a body mounted rigidly on the bottom of the flush tank;

a valve supported by a vertical tube, said valve being shifted axially in body;

a linking rod, shifted relative to the axis of the tube pivotally attached at one end to the tube, and intended to control the displacements of said valve;

an operating lever pivotally attached at one end to the other end of said linking rod and at the other end to said body a control rod, disposed substantially in the axis of the tube, and mechanically connected, on the one hand, to the lever and, on the other hand, to the operating member, and guided in a case mounted integral with the reservoir and transversely fixed thereto;

wherein the mechanical connection (19) between the rod (15) and the lever (12) is formed by way of a cog (20) carried by the rod and sliding in an elongated opening (21) between the ends of the lever (12); and wherein the mechanical connection (29) between the rod (15) and the operating member (16) is assured by means of a rocker bar (28) integral with the operating member (16) and cooperating in a lifting and sliding manner via a lateral extension (30) carried by the rod.

12. The discharge-valve actuating device for a flush tank reservoir according to claim 11, wherein the operating member (16) is pivotally mounted around a horizontal axis (31).

13. The discharge-valve actuating device for a flush tank reservoir according to claim 12, wherein the operating member (16) comprises a flat, circular base (34), closely neighboring the pivot axis and comprises an upper hemispherical face, recessed symmetrically relative to an axis in order that at each of the two positions, the member presents a protruding face on which a cog can rest for provoking the pivoting motion, where the other face is in continuity with the immediately neighboring face.

14. The discharge-valve actuating device for a flush tank reservoir according to claim 11, wherein the control rod comprises a nut (23) movable along the rod (15) by threads (40) and carrying the connection cog.

15. The discharge-valve actuating device for a flush tank reservoir according to claim 11, wherein the lever comprises two identical parallel arms (33), one on each side of the rod (15) and wherein at the end of the emptying, the automatic closing (27") of the valve brings about, by a mechanical connection "tube - linking rod lever - control rod - rocker bar", the return to a closing position (27) of the operating member (16).

16. The discharge-valve actuating device for a flush tank reservoir according to claim 11, wherein the upper end of the body (42) of the device comprises a sleeve (24) of a general cylindrical shape, fixed in height, and equipped with a threaded opening (25) intended to receive the case (18); and wherein the case (18) comprises on the outside a threading (41), intended to cooperate with the threading of the sleeve, and on the upper side an abutment shoulder (43) on the outer face of the cover lid (5), in such a way that the case is mounted and fixed in the sleeve (24) by screwing.

17. The discharge-valve actuating device for a flush tank reservoir according to claim 16, wherein the threading (41) of the case and the threading (40) of the rod (15) are coaxial and of the same pitch in order to simultaneously mount the rod (15) in the nut (23) and the case (18) in the sleeve (24).

* * * * *